United States Patent [19]

See

[11] Patent Number: 4,592,183

[45] Date of Patent: Jun. 3, 1986

[54] MODULAR ROOFING SYSTEM

[75] Inventor: Jacques L. See, Malibu, Calif.

[73] Assignee: Honeycomb Panels Patent Association, Inc., Malibu, Calif. ; a part interest

[21] Appl. No.: 552,801

[22] Filed: Nov. 17, 1983

[51] Int. Cl.[4] ..... E04D 1/34; E04D 1/26

[52] U.S. Cl. ..... 52/309.4; 52/521; 52/522; 52/536

[58] Field of Search ..... 52/536, 522, 521, 309.4

[56] References Cited

U.S. PATENT DOCUMENTS

| | | | |
|---|---|---|---|
| 1,438,780 | 12/1922 | O'Neil | 52/540 |
| 1,976,968 | 10/1934 | Sheldon | 52/522 |
| 2,159,136 | 5/1939 | Delk | 52/522 |
| 4,301,633 | 11/1981 | Neumann | 52/540 X |

FOREIGN PATENT DOCUMENTS

| | | | |
|---|---|---|---|
| 4811 | of 1914 | United Kingdom | 52/522 |

*Primary Examiner*—Alfred C. Perham
*Attorney, Agent, or Firm*—Fraser and Bogucki

[57] ABSTRACT

A module readily assembled roofing system for overlying a base structure, e.g. of a house or building, comprising a plurality of elongated modules of identical cross-section, each support including a principal body member defining a planar upper surface for the support and means defining a guideway or keyway aperture accessible from the undersurface of the support. The support also includes a planar web member extending from the principal body member and a locking member engaged to the free edge of the web member, including a terminal bead at the upper end of the locking member. The locking member mates with the guideway within an adjacent module such that one module is slideably received in mating relation within the guideway of an adjacent module to lock adjacent supports against vertical displacement. The web members are coupled to the base structure as by rivets, and a plurality of overlying covering members are affixed to the top surface of the body members. The principal body member may define a substantially hollow interior and insulating means such as plastic foam insulation strips may be provided for substantially filling the spaces within and between such members.

22 Claims, 5 Drawing Figures

MODULAR ROOFING SYSTEM

BACKGROUND OF THE INVENTION

The present invention relates to a modular roofing system and particularly to a roofing system which is suitable for low cost prefabricated housing and which minimizes installation costs while providing desired weather sealing, thermal insulation and fire protection.

To provide durable energy efficient, modern homes and buildings that can be quickly and inexpensively assembled, it is important to utilize roofing which satisfies conventional requirements at reasonable cost, in both materials and labor. A number of different types of synthetic or composite shingles have been proposed and some are now in use. However, these known roofing techniques are still based on certain fundamental premises, namely that insulation is to be used under the roof panel or structure and that shingles, tiles or other elements must be individually installed in successive rows on a conventional tarpaper or other underlayment. Asphalt sheeting, rock aggregate and other surface coverings do not require comparable labor but can be used only in certain geographical areas and have a number of limitations with regard to insulative properties and fire resistance.

The widespread demand for very low cost prefabricated housing involves monetary requirements that do not permit many heretofore conventional roofing designs and installation techniques to be used. Furthermore, materials such as asphalt shingles which are of low cost in one locality can become prohibitively expensive in another. It is also necessary to avoid the need for skilled labor and extensive on-site assembly, and to minimize transportation and handling costs.

SUMMARY OF THE INVENTION

The objectives of the present invention are achieved by the provision of modular roofing units for overlying a base structure which comprise a plurality of elongated horizontal supports, each support having a female guiding member and a spaced-apart male locking member. The positions of these elements are such that the female guiding member receives the male locking member of the next adjacent elongated support. Thus successively higher tiers of modules can be positioned in place very rapidly, and a large area can be installed quickly. Covering members from each tier, affixed to the upper side of each horizontal support, overlap the superior surface of at least the next lower tier. Thus a roof structure may be installed simply by aligning a first row of modules, fixing them in place, and then adding the successive modular tiers in ascending or descending rows.

One aspect of systems in accordance with the invention is that the female and male surfaces are positioned for sidewise insertion of one module into the next higher or lower module, so that long modular lengths can be employed. Another aspect is that with this arrangement both the body structures of the modules, as well as the upper surface shingles or tiles, overlap to provide a unified construction.

Further in accordance with the invention, a modular roofing system for installation over a base structure comprises a plurality of elongated supports having identical cross-sections, each support including a principal body member defining a planar upper surface for the support and a guideway therein accessible from the underside. Shingle elements or elongated sheets are fixed to the upper surface to provide an overlapped weather tight uppermost protective layer which may be decorative if desired. Each support also includes a planar web member extending from the principal body member and defining a bottom surface for the support, and a male locking member coupled to the free edge of the web member and configured to mate within the guideway within the adjacent support. Means, such as rivets, staples, or nails, are used for coupling the planar web members to the base structure. Elongated interior spaces of the modular support may be filled with foam or other insulation prior to or concurrently with installation. The interior guideway for the principal body may define a keyway aperture and the locking member may include a terminal bead at its upper end for entering in sliding mating relationship within the keyway aperture, thereby to lock adjacent supports against vertical displacement.

In one arrangement in accordance with the invention the principal body members have a substantially hollow interior and include one underside surface coplanar with the bottom surface of the web member and a second underside surface displaced from the bottom surface sufficiently to receive the web member of the adjacent support thereunder, so that adjacent members fit together without interference. The principal body member, web member, and locking member may comprise an integrally formed unit which can be formed as an integral extruded member of temperature resistant synthetic resin, or an integral molded unit of glass reinforced concrete.

BRIEF DESCRIPTION OF THE DRAWINGS

The invention will be more clearly understood by reference to the description below of certain exemplifications taken in connection with the accompanying drawings wherein.

DETAILED DESCRIPTION OF PREFERRED EMBODIMENT

Figure 1:
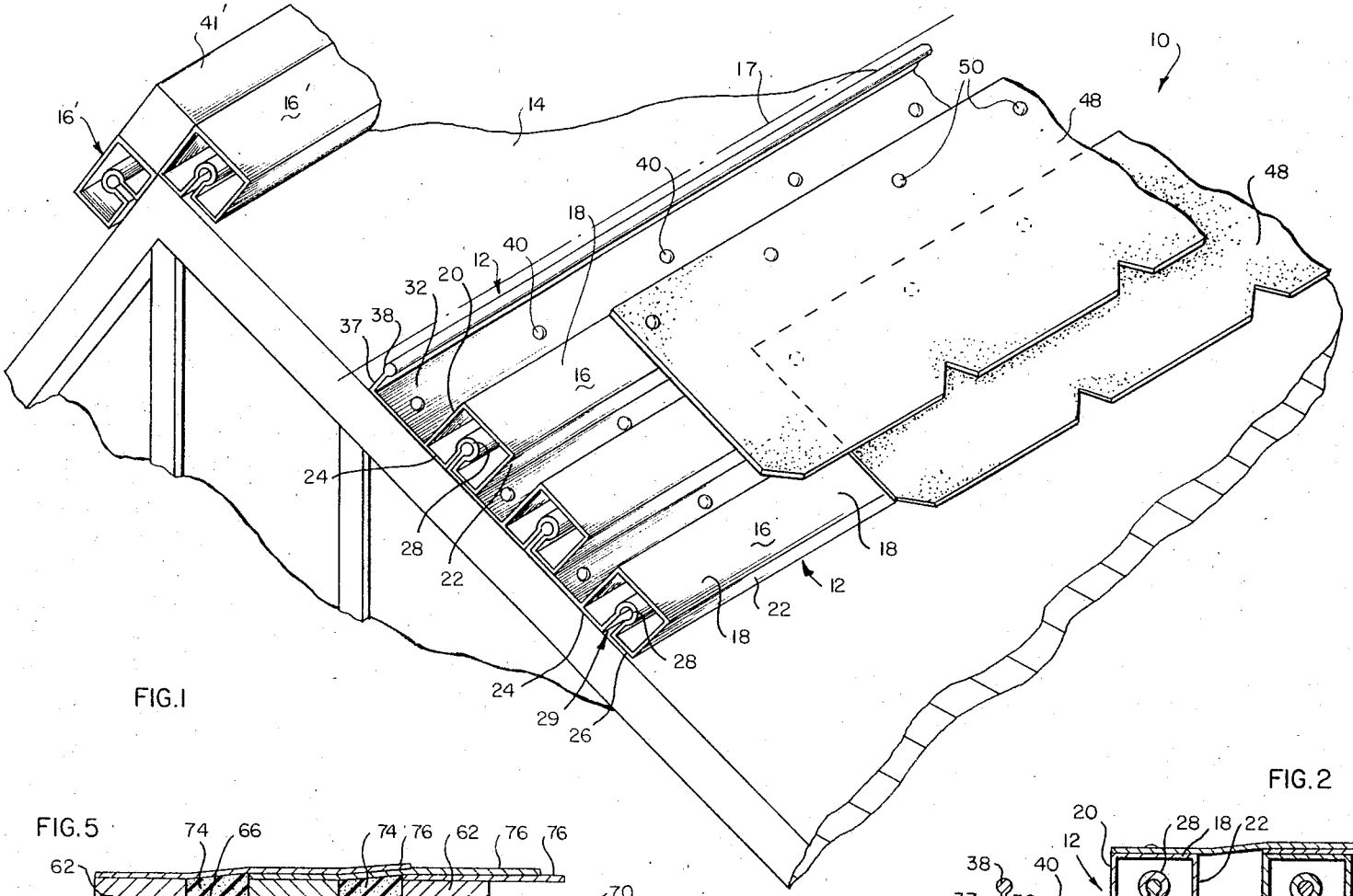
FIG. 1 is a perspective view of one example of a modular roofing system according to the invention, showing an interlocking arrangement of elongated supports together with the covering members or shingles.
Figure 2:
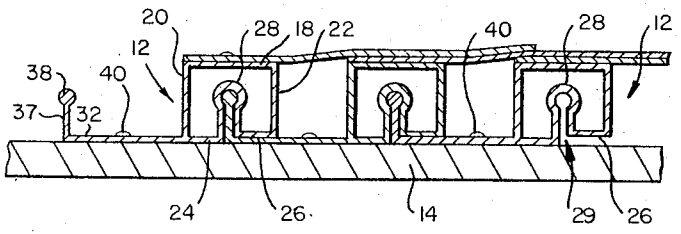
FIG. 2 is a side cross-sectional view of a portion of the arrangement of FIG. 1.

Referring now to the drawings, a modular roofing system 10 according to the invention comprises a plurality of elongated modules 12 of like cross-section, overlying a slanted structural base 14 for the roof of a residence or building. Although the base is shown as solid (e.g. pressed board or plywood) it may alternatively comprise spaced-apart boards or strips to which the modular units may be affixed.

Each elongated module has a principal body member 16 along an axis of elongation of the module, indicated by dotted line 17. The principal body member 16 here is approximately square in cross-section and includes an upper planar surface 18, sides 20 and 22, a first planar bottom or underside surface 24 and a second underside surface 26 which is vertically displaced from surface 24 for the reason noted below.

A guideway 28 in the form of a means defining a female keyway aperture or recess is intermediate the bottom surfaces 24 and 26, and is accessible from the underside of the body member at 29. The guideway 28 defines the inner periphery of a hollow interior within the body member 16 around the guideway 28, the hollow interior also being peripherally bounded by the opposite side walls 20 and 22, and the upper surface 18 and the bottom surfaces 24 and 26 of the body member 16. A planar web member 32 integrally connected to the bottom surface 24 extends outwardly beyond the side 22 of the body member 16, and normal to the axis of elongation of the support 12. The bottom surface 24 of the principal body member 16 is also coplanar with the bottom surface 34 of the web member 32.

The web member 32 includes an upstanding locking member connected to its free outer end and comprising a vertical planar member or riser 37 having a terminal bead 38. In this example the web member 32 extend upwardly, relative to the roof, from the principal body 16, but this juxtaposition could be reversed. It is seen that the locking member comprising the vertical member 37 and the terminal bead 38 are configured to be slideable in mating relationship within the keyway aperture 28 of an adjacent elongated module 12. Thus adjacent like modules 12 may be positioned correctly and also locked against vertical displacement by use of this mating relationship. For this purpose it will be noted that the second underside surface 26 of the module 12 is displaced from the bottom surface 24 of the module sufficiently to allow the outwardly extending planar bottom surface 24 of the next adjacent module 12 to pass beneath it, so that the successive modules 12 overlap in the region of the surface 26. In practice modules 12 are placed in end-to-end abutting relation along a given horizontal row. A weather resistant adhesive or sealant may be used along the joined edges. Then the next row of modules 12 may be slid into position, with the abutting edges in this row being horizontally displaced from the edges in the adjacent row.

The elongated modules 12 can be produced in extruded form wherein the principal body member 16, web member 32 and locking member are an integrally formed unit. Such modules can be comprised of a temperature resistant resin, for example, the material marketed as "Moplen," understood to be a polypropylene, which is nonflammable up to about 800° F., is self-extinguishing, and is a hard and rigid material. Other materials also can be employed for the elongated supports, such as an integral molded unit of glass reinforced cement. This material is relatively light in weight and highly flame resistant but can be cut, nailed or riveted without difficulty.

The modules 12 are fabricated in long sections, typically of 8 feet or more in length and are aligned in parallel rows or tiers on the inclined surface of the base 14. The elongated modules 12 are coupled to the base 14 by means of a number of nails or rivets 40 passing through the web members 32. In typical practice, each elongated module 12 in the lowermost row is first riveted to the base 14 after positioning. Then the adjacent row of modules 12 is then mated with the first row of modules, and riveted to the base 14, with the process being repeated until the top row is reached. This is consistent with conventional roof installation procedures. At the uppermost row a top ridge 41 including a pair of attached body members 16', with female guideways, is used for aesthetic and sealing purposes.

Figure 4:
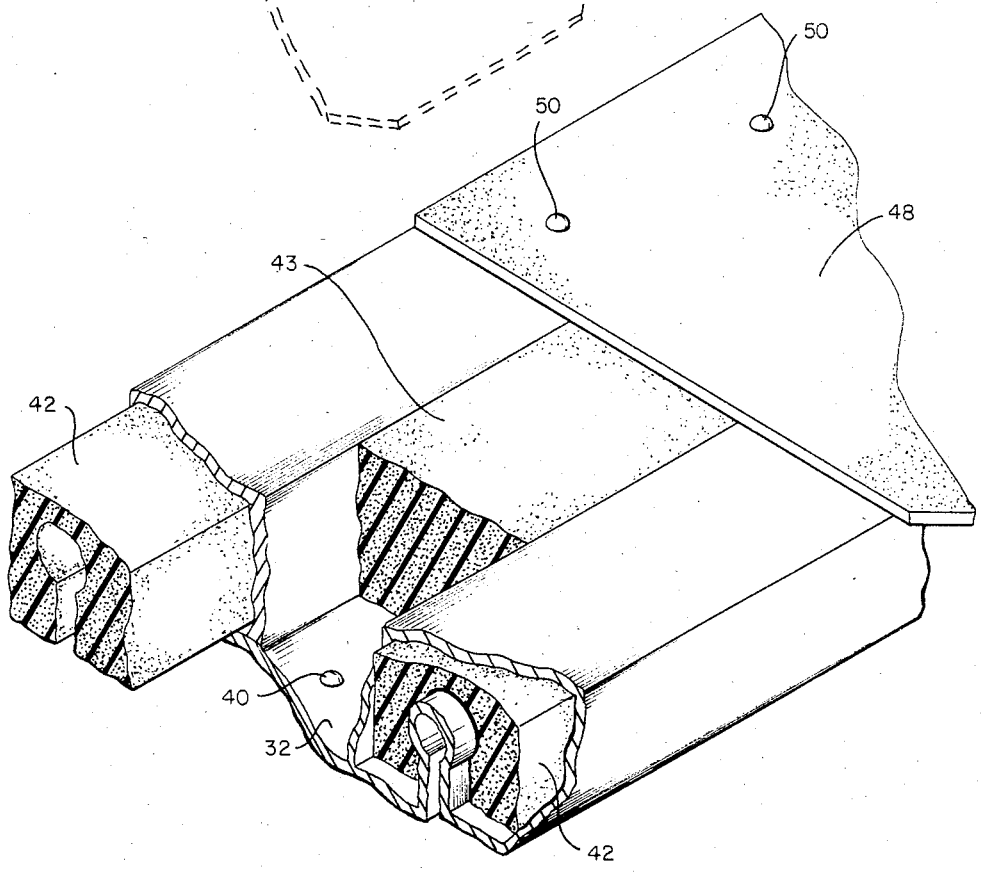
FIG. 4 is an enlarged perspective view showing incorporation of bodies or strips of insulation into interior channels within the modules.

Elongated plastic foam insulation strips 42 (FIG. 4 only), if not preinstalled, may then be placed in the hollow interior of body member 16 formed around the guideway 28 of each elongated support 12, to fill the hollow interior of the module. An insulation strip 43 may be inserted in the available space above the web member 32 as well, after the nails or rivets 40 are put in place.

Covering members 48 which may be in the form of individual elements or strips are connected by rivets 50 or other attaching means to the upper surface 18 of the elongated modules, and positioned to extend downwardly relative to the roof. The covering members are of sufficient length to overlap at least the covering members attached to the next lower adjacent module 12, but preferably overlap more than one module. It is preferred to preassemble the modules with the shingles attached, to minimize on-site labor. It is also preferred to use long covering members 48 of equal length to the module 12, although other arrangements, including individual shingles or tiles, can also be used. Such covering members 48 can be made of any suitably nonflammable plastic material, such as "Moplen", or asphalt, asbestos, composition, refractory shingles, or other conventional material.

As a further alternative, the shingles can be connected to the upper surface 18 of the module 12 by providing a groove in the top surface 18, with a tongue on the shingles, to form a tongue and groove connection instead of using rivets.

Figure 5:
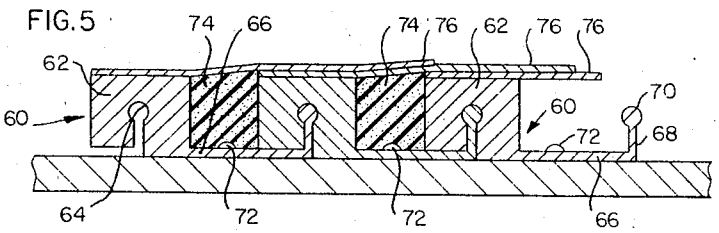
FIG. 5 is a side sectional fragmentary view of a different configuration of a modular roofing system in accordance with the invention.
Figure 3:
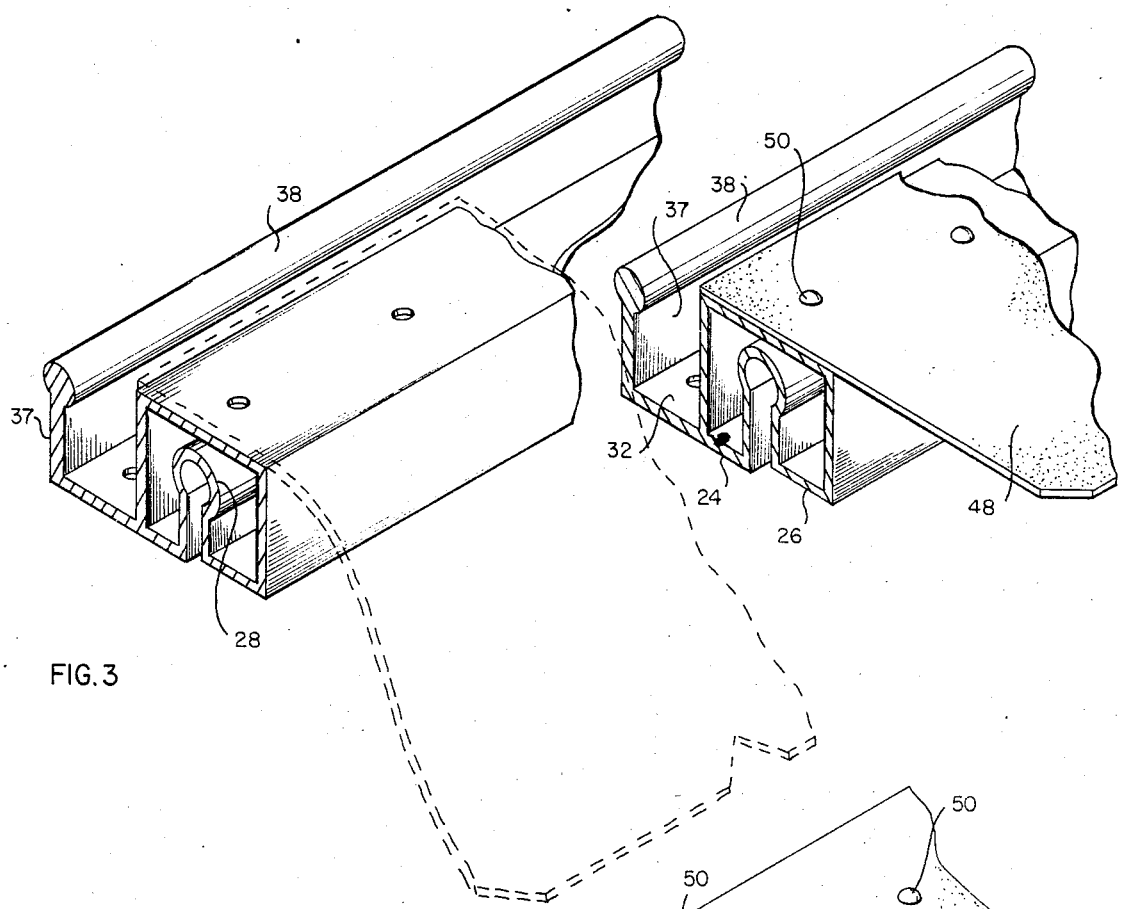
FIG. 3 is a perspective view showing the positioning of one elongated support with respect to an adjacent support, prior to slideable interlocking engagement of the supports.

The modules 12, of extruded plastic, are chosen to be approximately 2" high, but can be of greater or lesser height, depending on cost and installation requirements. Such modules are rugged, conveniently handled and withstand all normal service use, including support of work crews. It should be noted that if the web member is on the lower side of the principal body, as shown in the example of FIG. 5, the task of attaching the modules to the base becomes more complicated, unless the covering members are installed on site. In FIG. 5, the modules 60 are shown in a form molded of glass reinforced concrete, with a solid principal body 62 incorporating an interior keyway 64 accessible from the underside. The web member 66 in this example extends downwardly to the next lower module, where the male member comprising an upstanding strip 68 and a terminal bead 70 fit in mating relation within the keyway of that module. In assembling these tiers one may start at the top and proceed down, or vice versa. After securing the web members 66 by rivets 72 or other means, the space between the body 62 and upstanding strip 68 may be filled with an insulative strip 74, here glass reinforced concrete. Then the cover members 76, also of glass reinforced concrete, are riveted, stapled or nailed in place to give a highly fire and damage resistant structure with excellent insulative properties.

From the foregoing, it is seen that the invention provides a novel simple modular roofing system formed of a plurality of unitary elongated modules which can be readily assembled by slidable mating engagement with each other and connected to a base structure to form a support for an overlying cover or shingles. Overlapping of the body structures as well as the covering surfaces enables rapid but precise positioning while abetting the sealing characteristics and structurally unifying the assembly.

Since various changes and modifications of the invention will occur to and can be made readily by those skilled in the art without departing from the invention concept, the invention is not to be taken as limited except by the scope of the appended claims.

What is claimed is:

1. A modular roofing system for overlying a base structure comprising:

a plurality of elongated modules having identical cross-sections, each module including a principal body member defining a planar upper surface for the module and a recessed guideway therein accessible from the underside thereof, the module also including a planar web member extending from the principal body member and defining a bottom surface for the module, and a locking member engaged to the free edge of the web member and spaced apart from the body member, the locking member being configured to mate within the recessed guideway within the adjacent module, the modules being disposed in successive tiers with the locking members of one tier mating within the recessed guideways of an adjacent tier; and a plurality of overlying covering members affixed to the planar upper surface of the principal body members.

2. The system as set forth in claim 1, wherein the elongated modules are disposed in rows along a slanting base structure, and wherein the locking member defines one edge of each module, and wherein the covering members extend downwardly from the planar upper surface substantially parallel to the bottom surface and of sufficient length to overlap covering members in at least the adjacent row.

3. The system as set forth in claim 2, further including means for engaging the web members to the base structure, and wherein the covering members define elongated strip members extending along a substantial portion of the length of the modules.

4. The system as set forth in claim 2, wherein said principal body member, web member and locking member are an integral formed unit.

5. The system as set forth in claim 4, wherein said module is an integral extruded member of temperature resistant synthetic resin, and the body member includes means defining a hollow interior about the guideway therein.

6. The system as set forth in claim 4, wherein said module is an integral molded unit of glass reinforced cement and the body member is a substantially solid member including means defining the guideway therein.

7. The system as set forth in claim 1, wherein the body member includes one underside surface coplanar with the bottom surface of the web member and a second underside surface displaced from the bottom surface sufficiently to receive the web member of the adjacent support thereunder, such that the modules both overlap and interlock.

8. The system as set forth in claim 7, wherein the system further includes insulating means for substantially filling spaces within and between body members under the covering members.

9. A modular roofing system for overlying a base structure comprising:

a plurality of elongated modules having identical cross-sections, each module including a principal body member defining a planar upper surface for the module and an interior guideway their in accessible from the underside thereof, wherein the interior guideway for the principal body member defines a keyway aperture, the module also includes a planar web having a free edge extending form the principal body member and defining a bottom surface for the module, said body member further includes one underside surface coplanar with the bottom surface of the planar web and a second underside surface displaced from the bottom surface sufficiently to receive the planar web of an adjacent module thereunder, and a locking member engaged to the free edge of the planar web, said locking member having a vertically extending strip having an upper and a lower end, wherein the locking member includes a terminal bead at the upper end thereof adapted to be received in a mating relationship within a keyway aperture of an adjacent module so that said modules are disposed in successive tiers with the locking member of a module in one tier mating within the keyway aperture of the adjacent module in the next tier, to lock adjacent modules against vertical displacement; and a plurality of overlyng covering members affixed to the planar upper surface of the principal body members.

10. A readily assembled module roof structure for overlayment on a base structure and comprising:

a plurality of modules of like cross-section, the modules each comprising integral elongated units having a principal body along an axis of elongation and a web extending normal thereto, and also comprising a male member coupled to the web at a spaced apart region from the principal body and means defining a female recess in the principal body for receiving the male member of an adjacent module in mating relation, both the female recess and the male member extending parallel to the axis of elongation of the module and so spaced that successive rows of modules may be joined together in side-by-side relation and precisely placed by the mating relationship therebetween; and surface cover means coupled to the principal body of each module to overlie at least the next lower row.

11. The structure as set forth in claim 10, wherein the female recess in the principal body is accessible from the underside thereof, and wherein the system additionally includes means disposed along the webs for attaching the individual modules to the base structure.

12. The structure as set forth in claim 11, wherein the principal body of said modules has a planar upper surface, said surface cover means being positioned on said upper planar surface, and means defining a planar lower surface supported on said base structure.

13. The structure as set forth in claim 12, wherein the surface cover means comprises at least one cover member extending downwardly from the planar upper surface of a module and of sufficient length to overlap at least one cover member in a lower module.

14. The structure as set forth in claim 11, wherein said means for attaching comprises rivet means coupling the web to the base structure and the structure also comprises rivet means for attaching the surface cover means to the principal body.

15. A readily assembled module roof structure for overlayment on a base structure and comprising:

a plurality of modules of like cross-section, the modules each comprising integral elongated units having a principal body along an axis of elongation and a web extending normal thereto, and also comprising a male member coupled to the web at a spaced apart region from the principal body, wherein the male member is integrally attached to the free end of the web and comprises a vertically extending member and a terminal bead mounted on the upper end of said vertical member and means defining a female recess in the principal body for receiving the male member of an adjacent module in mating relation, wherein the female recess in the principal body is accessible from the underside thereof, both the female recess and the male member extending parallel to the axis of elongation of the module and so spaced that successive rows of modules may be joined together in side-by-side relation and precisely placed by the mating relationship therebetween; and means disposed along the webs for attaching the individual modules to the base structure; and surface cover means coupled to the principal body of each module to overlie at least the next lower row.

16. The structure as set forth in claim 15, wherein the free end of the web is received in the female recess and passes below a bottom surface of the principal body of an adjacent module.

17. The structure as set forth in claim 16, wherein the principal body is a substantially solid member including a female recess therein, and the module is of glass reinforced concrete.

18. The structure as set forth in claim 17, wherein the male member of a module is positioned on the lower side of a roof relative to the principal body and wherein the structure also includes insulating means disposed under the surface cover means between the principal body and the male member.

19. The structure as set forth in claim 15, wherein said principal body defines a substantially hollow interior and wherein the principal body includes a first underside surface coplanar with and connected to the bottom surface of the web and a second undersurface displaced from the first undersurface and forming a recess between the body and the base structure to receive the web of the adjacent support.

20. The structure as set forth in claim 19, wherein the structure further includes elongated foam insulation strips for substantially filling the hollow interior of said bodies around said female recess therein, and for substantially filling the space under the surface cover means between the principal body and the male member.

21. The structure as set forth in claim 20, wherein the male member of a module is positioned on the upper side of a roof relative to the principal body.

22. A module roof structure for placement on a base structure comprising:

a plurality of modules of like cross-section, the modules each comprising integral elongated units having a principal body along an axis of elongation, a web extending normal thereto, and including a male member integrally attached to the free end of the web, said male member comprising a vertically extending strip and a terminal bead mounted on the upper end of said strip, said principal body including means defining a female recess therein for receiving the male member in mating relationship, said female recess defining a keyway aperture accessible from the underside of said principal body, said strip and said terminal bead on said male member being received in said keyway aperture through the underside of said principal body for locking adjacent modules together against vertical displacement relative to the roof, the free end of said web passing below one part of the surface of the principal body of an adjacent module, both the keyway structure and the male member extending parallel to the axis of elongation of said modules and so spaced that successive vertically displaced modules may be joined together and precisely placed in parallel relation by the mating relationship therebetween, the principal body of said modules having a planar upper surface and a planar lower surface supported on said base structure;

a plurality of shingles positioned on said upper planar surface of a module and of sufficient length to overlap shingles on at least the adjacent module;

rivet means disposed along the webs for attaching the individual modules to the base structure; and rivet means for attaching said shingles to the upper surface of said modules.

* * * * *